US006569987B1

(12) United States Patent
Ohba et al.

(10) Patent No.: US 6,569,987 B1
(45) Date of Patent: May 27, 2003

(54) PROCESS FOR PRODUCING META-AROMATIC POLYAMIDE FIBER

(75) Inventors: Akihiro Ohba, Iwakuni (JP); Takashi Yoshitomi, Iwakuni (JP); Hirozumi Iwasaki, Yao (JP); Kotaro Takiue, Matsuyama (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/868,863

(22) PCT Filed: Oct. 20, 2000

(86) PCT No.: PCT/JP00/07353

§ 371 (c)(1),
(2), (4) Date: Jun. 21, 2001

(87) PCT Pub. No.: WO01/29296

PCT Pub. Date: Apr. 26, 2001

(30) Foreign Application Priority Data

Oct. 21, 1999 (JP) ..... 11-299496
Dec. 16, 1999 (JP) ..... 11-357315

(51) Int. Cl.[7] ..... C08G 69/00; C08G 69/46; D01D 5/06; D01F 6/60; C08F 6/00

(52) U.S. Cl. ..... 528/310; 528/480; 528/488; 528/489; 528/499; 528/502 R; 528/502 A; 528/502 B; 528/503; 264/184; 264/210.4; 264/210.5; 264/210.8; 264/211.15; 264/211.16; 264/233

(58) Field of Search ..... 528/310, 480, 528/488, 489, 499, 502 R, 502 A, 502 B, 503; 264/184, 210.4, 210.5, 210.8, 211.15, 211.6, 233

(56) References Cited

U.S. PATENT DOCUMENTS 3,063,966 A 11/1962 Kwolek et al. ..... 260/78
3,360,595 A 12/1967 Wittels ..... 264/63
5,667,743 A * 9/1997 Tai et al. ..... 264/184

FOREIGN PATENT DOCUMENTS

| | | | |
|---|---|---|---|
| EP | 0 567 987 A1 | 11/1993 | ..... D01F/6/60 |
| JP | 47-10863 | 3/1972 | |
| JP | 48-4461 | 2/1973 | ..... C08G/41/00 |
| JP | 48-17551 | 5/1973 | ..... C08G/41/00 |
| JP | 49-128096 | 12/1974 | |
| JP | 8-74121 | 3/1996 | ..... D01F/6/60 |
| JP | 8-74122 | 3/1996 | ..... D01F/6/60 |
| JP | 8-74123 | 3/1996 | ..... D01F/6/60 |
| JP | 10-53920 | 2/1998 | ..... D01F/6/60 |
| JP | 10-88421 | 4/1998 | ..... D01F/6/60 |
| WO | 94/23099 | 10/1994 | ..... D01F/6/60 |

* cited by examiner

*Primary Examiner*—P. Hampton-Hightower
(74) *Attorney, Agent, or Firm*—Sughrue Mion, PLLC

(57) ABSTRACT

To produce meta aramid filaments having a good quality from a polymer solution of a meta aramid produced by a solution polymerization method, with high efficiency, (1) a meta aramid is prepared by polymerization-reacting a aromatic meta-diamine with a aromatic meta-dicarboxylic acid chloride in a polar organic solvent; (2) hydrogen chloride contained in the resultant polymer solution is neutralized with a neutralizing agent containing an alkali metal hydroxide which can react with hydrogen chloride to produce a salt thereof insoluble in the polymerization solvent; (3) the salt deposited from the polymer solution is removed by filtration; (4) the resultant polymer solution is mixed with water and a polar organic amide solvent to prepare a spinning solution; (5) the resultant meta aramid spinning solution is directly extruded in the form of filamentary streams into an aqueous coagulation liquid, to coagulate the extruded filamentary streams of the polymer solution into the form of filaments; (6) the coagulated filaments are immersed in water to remove the salt and the solvent from the filaments; and (7) the water-washed filaments are drawn and heat-treated.

10 Claims, No Drawings

PROCESS FOR PRODUCING META-AROMATIC POLYAMIDE FIBER

TECHNICAL FIELD

The present invention relates to a process for producing meta aramid filaments having improved quality and an enhanced productivity.

BACKGROUND ART

A meta aramid has a molecular skeleton consisting essentially of aromatic cyclic structures and thus has exhibit excellent heat resistance and flame resistance. Therefore, the meta aramid is employed for the uses of filaments, films and sheets My for which high heat resistance and flame resistance important.

Filaments of above-mentioned meta aramid (which may be referred to as meta-type armide hereinafter), for example, poly-meta-phenyleneisophthalamide filaments, are generally produced by one of the following two industrial methods.

Namely, in the first method, a poly-meta-phenyleneisophthalamide solution is produced by low temperature solution polymerization of meta-phenylenediamine with isophthalic acid chloride in N,N-dimethylacetamide; hydrochloric acid dissolved, as a by-product, in the above-mentioned solution is neutralized with calcium hydroxide; and the polymer solution comprising calcium chloride produced by the above-mentioned neutralization and dissolved in the solution is directly subjected to a dry-spinning procedure, as disclosed in Japanese Examined Patent Publication No. 35-14,399 and U.S. Pat. No. 3,360,595. In this method, the content of calcium chloride contained in the polymer solution is about 45% by weight, based on the weight of the polyamide.

In the second method, meta-phenylenediamine is reacted with isophthalic acid chloride in an organic solvent, for example, tetrahydrofuran, which is not a good solvent for a meta-type aramid produced from the reaction; the reaction system is brought into contact with an aqueous solution system containing an inorganic acid-acceptor and water-soluble neutral salt, to cause the reaction to be completed; the resultant poly-meta-phenyleneisophthalamide produced in a powder form is isolated (as shown in Japanese Examined Patent Publication No. 47-10,863); the polymer powder is dissolved in an amide-type solvent; and the resultant solution is subjected to a wet-spinning procedure using an inorganic salt-containing aqueous coagulation bath, as shown in Japanese Examined Patent Publication No. 48-17,551.

The first method is advantageous in that the polymer solution can be used as a spinning solution without isolating the polymer, but is disadvantageous in that the spinning procedure is carried out in a dry-spinning method using an amide-type solvent having a high boiling temperature, and thus the energy cost for the spinning procedure is high, and when the number of spinning holes per spinneret is increased, the stability of the spinning procedure is significantly decreased. When the polymer solution is subjected to a wet-spinning procedure using an aqueous coagulation liquid, to solve the above-mentioned problems, almost all of the resultant filaments are devitrificated fibers having a low mechanical strength. Therefore, this wet-spinning method has not yet industrially utilized.

The second method is advantageous in that the problems of the first method do not occur, but is disadvantageous in that the solvent for the polymerization system is different from the solvent for the spinning system, a procedure for re-dissolving the polymer which has been isolated from the polymerization system is necessary and, to obtain a stable solution of the re-dissolved polymer, specific care and an accurate control for the re-dissolving procedure are necessary, as disclosed in Japanese Examined Patent Publication No. 48-4,661.

To solve the above-mentioned problems, currently various attempts have been made to obtain meta-type aramid filaments having a high mechanical strength without loss of clarity of the filaments by wet-spinning a meta-type aramid polymer solution prepared by a solution polymerization.

For example, Japanese Unexamined Patent Publication No. 10-88,421 and No. 10-53,920 provide a process in which a meta aramid solution containing a salt, at a concentration of 3% by weight or more, is used as a spinning solution; the spinning solution is wet-spun in an aqueous coagulation bath containing a solvent and a salt each in a specific range of concentration, at a specific range of temperature; the spun filaments are treated in a condition-controlling liquid having specific ranges of solvent concentration and salt concentration at a specific temperate range; and the condition-controlled filaments are drawn in an aqueous drawing bath having specific ranges of solvent concentration and a specific salt concentration at a specific temperature range. It is sure that the above-mentioned process enables filaments having excellent mechanical properties to be obtained with a reduced generation of voids. However, this process has a problem that the productivity of the filaments is lower than that of the process in which a spinning solution containing substantially no inorganic salt is used.

As another process, Japanese Unexamined Patent Publications No. 8-74,121 and No. 8-74,122 disclose a process in which an aromatic diamine is reacted with an aromatic dicarboxylic acid chloride in an amide-type solvent; the resultant meta aramid solution containing hydrochloric acid produced as a by-product is neutralized with calcium hydroxide, calcium oxide or calcium carbonate; the resultant neutralized solution containing an inorganic salt in a high concentration is mixed with specific amounts of an amide-type solvent and water; and the resultant liquid containing the polymer and water each in a specific range of content is employed as a spinning solution for a wet spinning procedure. When the above-mentioned process is carried out by using an aqueous coagulating liquid, the coagulating agent is prevented from penetrating into the coagulated filaments, and thus filaments having a low void content and a high transparency can be produced with a high stability. The filaments have a high drawability and thus drawn filaments having excellent mechanical properties can be obtained. This process, however, has such a problem that when the number of extruding holes of the spinneret is large, for example, 1,000 or 30,000 per spinneret, the wet-spinning with a high stability is difficult, and thus the production of aramid filaments having excellent quality with a high productivity cannot be carried out.

On another hand, as processes for wet-spinning a spinning solution having a low content of the inorganic salts, various processes in which hydrogen chloride produced by the polymerization procedure is neutralized with a specific neutralizing agent which causes a salt produced by the neutralization reaction to be insoluble in the solvent for the polymerization. However, when ammonia gas is used as shown in Japanese Unexamined Patent Publication No. 35-14,399 and Japanese Unexamined Patent Publication No.

49-129,096, it is difficult to completely remove the resultant insoluble ammonium chloride salt from the neutralized intermediate product, and thus, a problem that not only the spinning nozzles are readily soiled, but also that the stability of the wet-spinning procedure is insufficient, occurs. In the processes using a solid neutralizing agent in the form of granules, for example, sodium carbonate or sodium hydroxide, since the neutralization is carried out in the manner of a solid/liquid reaction, and the resultant neutralized salt is insoluble in the solvent and thus deposited on the surfaces of the neutralizing agent granules, the neutralization cannot be completely effected.

Also, in the neutralization procedure using hydrogen solidum carbonate in the state of a solid, as a neutralizing agent, carbon dioxide gas is generated during the neutralization reaction to remove the resultant neutralized salt from the surfaces of the solid neutralizing agent granules and to improve the efficiency of the neutralization procedure. However, the neutralization is imperfectly effected, and the generated gas causes bubbles in the resultant polymer solution and the spinnability of the polymer solution is reduced.

DISCLOSURE OF THE INVENTION

An object of the present invention is to provide a process, for producing meta aramid filaments, in which process high quality filaments can be produced by a wet-spinning procedure and the productivity of the filaments can be greatly enhanced.

Another object of the present invention is to provide a process, for producing meta aramid filaments, in which process hydrogen chloride produced as a by-product in a polymerization procedure can be neutralized with a high efficiency, the by-product salt can be easily removed, and thus the resultant polymer solution can be easily employed, after only a filtration treatment, for a wet-forming procedure, for example, as a spinning solution for a wet-spinning procedure, and by which process, high quality filaments can be produced by a wet-spinning procedure and the productivity of the filaments can be greatly enhanced.

The above-mentioned objects can be attained by the process of the present invention for producing meta aramid filaments.

The process of the present invention for producing meta aramid filaments by preparing a polymer solution of a meta aramid by a solution polymerization method and producing meta aramid filaments from the polymer solution, comprises the series of steps (1) to (7) of:

(1) a polymerization step in which a meta aramid is prepared by reacting a aromatic meta-diamine with a aromatic meta-dicarboxylic acid chloride in a polar organic solvent;

(2) a neutralization step in which hydrogen chloride contained in the polymer solution obtained in the polymerization step (1) is neutralized with a neutralizing agent comprising an alkali metal hydroxide capable of producing a salt insoluble in the polymerization solvent when reacted with the hydrogen chloride;

(3) a filtering step in which the salt deposited from the polymer solution in the neutralization step (2) is removed by filtration;

(4) a spinning solution-preparation step in which the polymer solution obtained in the filtering step (3) is mixed with water and a polar organic amide solvent, to provide a spinning solution;

(5) a coagulation step in which the meta aramid-spinning solution obtained in the spinning solution-preparation step (4) is directly extruded in filamentary streams into an aqueous coagulation liquid to coagulate the extruded spinning solution streams into the form of filaments;

(6) a water-washing step in which the filaments delivered from the coagulation step (5) are immersed in water to remove the salts and the solvent from the filaments; and (7) drawing and heat-treatment steps in which the filaments delivered from the water-washing step (6) are drawn and heat-treated.

In the process of the present invention for producing meta aramid filaments, preferably in the spinning solution-preparation step (4), the meta aramid solution is added to a polar organic solvent-water mixed liquid having a water content of 25% by weight or less.

In the process of the present invention for producing meta aramid filaments, preferably 85 molar % or more of the recurring units of the meta aramid obtained in the polymerization step (1) are meta-phenyleneisophthalamide units.

In the process of the present invention for producing meta aramid filaments, preferably the polar organic amide solvent used in the polymerization step (1) is N-methyl-2-pyrrolidone or N,N-dimethylacetamide.

In the process of the present invention for producing meta aramid filaments, the alkali metal hydroxide which reacts with hydrogen chloride in the neutralization step (2) to form the salt insoluble in the polymerization solvent is preferably sodium hydroxide or potassium hydroxide.

In the process of the present invention for producing meta aramid filaments, preferably in the neutralization step (2), the polymer solution is added with an aqueous solution of the alkali metal hydroxide.

In the process of the present invention for producing meta aramid filaments, the alkali metal hydroxide is preferably in a concentration of 20 to 70% in the aqueous alkali metal hydroxide solution.

The process of the present invention for producing meta aramid filaments optionally further comprises a step (8) for adding calcium chloride or lithium chloride to the copolymer solution, before the neutralization step.

In the process for producing meta aramid filaments, preferably in the neutralization step (2), the neutralizing agent contains at least one member selected from calcium hydroxide and lithium hydroxide, and 5 to 55 molar % of the total amount of hydrogen chloride contained in the polymer solution are neutralized with calcium hydroxide and/or lithium hydroxide.

In the process of the present invention for producing meta aramid filaments, the spinning solution preferably contains calcium chloride and/or lithium chloride in an amount of 3 to 25% by weight based on the weight of the meta aramid.

In the process of the present invention for producing meta aramid filaments, the spinning solution preferably contains the meta aramid in a concentration of 12 to 18% by weight, and water in a content of 25 to 70% by weight based on the weight of the meta aramid.

In the process of the present invention for producing meta aramid filaments, preferably, in the polymerization step (1), the organic polar solvent comprises at least one member selected from N-methyl-2-pyrrolidone, N,N-dimethylacetamide, N,N-dimethylformamide, dimethylsulfoxide, N-methylcaprolactame, N,N,N',N'-tetramethylurea.

BEST MODE OF CARRYING OUT THE INVENTION

In the process of the present invention, firstly a meta aramid is produced by the step (1) in which the meta-type aromatic amine and the aromatic meta-dicarboxylic acid halide, which will be exemplified below, are reacted with each other in a polar amide solvent. In this step, additional para-type aromatic compounds may be copolymerized as a copolymerization component.

As the aromatic meta-diamine as mentioned above, meta-phenylenediamine, 3,4'-diaminodiphenylether, and 3,4'-diaminodiphenylsulfone; and derivatives of the above-mentioned compounds having substituents such as halogen atoms and/or alkyl groups having 1 to 3 carbon atoms, attached to the aromatic cyclic structures thereof, for example, 2,4-toluylenediamine, 2,6-toluylenediamine, 2,4-diaminochlorobenzene, and 2,6-diaminochlorobenzene, may be employed. Particularly, preferably, meta-phenylenediamine or mixed diamines containing meta-phenylene diamine in a content of 85 molar % or more, more preferably 90 molar % or more, still more preferably 95 molar % or more are employed.

Also, as the aromatic meta-dicarboxylic acid halides, isophthalic acid halides, for example, isophthalic acid chloride and isophthalic acid bromide; and derivatives of the above-mentioned compounds having substituents, for example, halogen atoms and/or alkoxy groups having 1 to 3 carbon atoms, for example, 3-chloroisophthalic acid chloride and 3-methoxyisophthalic acid chloride, may be employed. Particularly, preferably, isophthalic acid chloride and mixed carboxylic acid halides containing isophthalic acid chloride in a content of 85 molar % or more, more preferably 90 molar % or more, still more preferably 95 molar % or more, are employed.

In the copolymerization components usable in combination with the diamines and the carboxylic acid halides, the comonomeric aromatic diamines include benzene derivatives such as para-phenylene diamine, 2,5-diaminochlorobenzene, 2,5-diaminobromobenzene and aminoanisidines; and 1,5-naphthylenediamine, 4,4'-diaminodiphenylether, 4,4,-diaminodiphenylketone, 4,4'-diaminodiphenylamine, 4,41-diaminodiphenylmethane. Also, the comonomeric aromatic dicarboxylic acid halides include terephthalic acid chloride, 1,4-naphthalenedicarboxylic acid chloride, 2,6-naphthalenedicarboxylic acid chloride, 4,4'-biphenyldicarboxylic acid chloride and 4,4'-biphenylethercarboxylic acid chloride.

If the copolymerization component is employed in too large an amount, the resultant meta aramid may exhibit a degraded property. Thus the copolymerization component is preferably used in an amount of 15 molar % or less, more preferably 10 molar % or less, based on the total molar amount of the acid components for the polyamide.

The preferable meta aramid for the present invention is a polyamide having recurring meta-phenylene isophthalamide units in a content of 85 molar % or more, more preferably 90 molar % or more, still more preferably 95 molar % or more, further preferably 100 molar % based on the total recurring units.

The organic polar solvents usable for the present invention include N-methyl-2-pyrrolidone (NMP), dimethylformamide (DMF), dimethylacetamide (DMAc), dimethylsulfoxide (DMSO), N-methylcaprolactame, and N,N,N',N'-tetramethylurea. Particularly, NMP and DMAc are preferably employed.

The meta aramid obtained by the polymerization in step (1) preferably has a degree of polymerization corresponding to an intrinsic viscosity (IV) of 1.3 to 3.0, more preferably 1.7 to 2.2, determined by using a concentrated sulfuric acid as a solvent, at a temperature of 30° C.

Since the polymerization solution obtained by the polymerization step contains hydrogen chloride produced as a by-product of the polymerization reaction, the polymerization solution is subjected to a neutralization treatment in step (2). The neutralizing agent is not necessarily limited to that of a specific type, as long as the salt produced by the neutralization reaction is a alkali metal compound insoluble in the polymerization medium (polar organic amide solvent). However, from economical view point, sodium hydroxide and potassium hydroxide, particularly sodium hydroxide, is preferably employed. Also, unless the object of the present invention is hindered, other neutralizing compounds may be employed. For example, lithium hydroxide, calcium hydroxide and calcium oxide, which are soluble in the polymerization solvent, may be employed together with the above-mentioned neutralizing agent.

In step (2), the alkali metal hydroxide may be added in the form of fine particles or in the state of a solid, or in the state of an aqueous solution. Generally, the aqueous solution of the alkali metal hydroxide is preferably employed to neutralize hydrogen chloride produced by the polymerization reaction with a high efficiency, and to enhance the neutralization processability and the filtering property of the neutralized salt in the filtration step (3) which will be explained hereinafter, and the concentration of the neutralizing agent in the aqueous solution is preferably 20 to 70% by weight more preferably 30 to 60% by weight.

If the concentration of the neutralizing agent in the aqueous solution is too high, the sodium hydroxide or potassium hydroxide are easily deposited as a solid during the neutralization reaction and thus the neutralization is difficult to uniformly effect.

The neutralized salt produced as a by-product of the neutralization reaction exhibits a low solubility in the organic solvent-containing polymerization solution and, thus, is substantially not dissolved in the polymerization solution and deposits as solid particles and, therefore, the neutralized salt is removed by filtration in step (3). There is no limitation to the type of the filtering system and, thus, conventional methods, for example, filtration or centrifugal separation, can be utilized. In this case, there is no limitation to the filtration system and to the filtration material and, thus, conventional filtration systems and materials and specifically designed systems and materials may be utilized.

In the filtration step, if the temperature of the neutralized solution is too high, the stability of the solution may decreased and the content of the salt in the solution may increase, and if the neutralized solution temperature is too low, the filtration property of the solution decreases. Thus, the filtration temperature is preferably in the range between 50 and 90° C., particularly between 70 and 90° C.

Then, into the meta aramid solution obtained in the filtering step (3), water and a polar organic amide solvent are added together, to prepare a spinning solution (step (4)). In this step, water is preferably added in the state of a solution of water in a content of 25% by weight in the organic amide solvent. In the spinning solution, the concentration of the polymer is preferably controlled to 12 to 18% by weight, particularly 15 to 17% by weight. Also, the content of water is preferably 25 to 70% by weight, more preferably 30 to 50% by weight, based on the weight of the above-mentioned polymer.

By preparing the spinning solution having the polymer concentration and the water content in the range as mentioned above, the step stability of the wet spinning step (5) which will be explained below is enhanced, and also, the transparency of the obtained filaments is increased, and the quality of the filaments is improved.

Also, the meta aramid-spinning solution obtained in the above-mentioned step (4) may contain therein calcium chloride and/or lithium chloride, for the purpose of enhancing the stability of the solution. There is no limitation to means for causing the salts to be contained in the spinning solution. For example, in a stage before the neutralization step, for example, in the polymerization step, calcium chloride and/or lithium chloride may be added to the polymerization reaction solution, or in a stage before or simultaneously with the neutralization step using sodium hydroxide and/or potassium hydroxide, a portion, (preferably 5 to 55 molar %) of hydrogen chloride produced in the polymerization step may be neutralized with calcium hydroxide and/or lithium hydroxide so that the resultant calcium chloride and/or lithium chloride produced as a by-product is dissolved and contained in the spinning solution.

The calcium chloride and/or lithium chloride is preferably contained in a content of 3 to 25% by weight, more preferably 10 to 20% by weight based on the weight of the meta aramid, in the spinning solution. By controlling the content of calcium chloride and/or lithium chloride to as mentioned above, when water is contained, the stability of the resultant spinning solution is enhanced and simultaneously the coagulating property of the polymer during the wet-spinning procedure is enhanced and thus aramid filaments having excellent quality can be obtained.

The meta aramid solution obtained in the spinning solution-preparation step (4) is fed to step (5) in which the polyamide solution is spun into polyamide filaments by using a wet spinning apparatus. Namely, the spinning solution is directly extruded into an aqueous coagulation liquid and coagulated into the form of solid filaments.

The coagulated polyamide filaments are taken up from the coagulation bath and are immersed in water-washing liquid in the water-washing step (6) (preferably in multistage water-washing step), to control the content of the solvent and the content of the salt remaining in the filaments, and then the polyamide filaments are passed through the draw-heat treating step (7) and thereafter are optionally contained in the form of a tow in a packing can or are wound up or are directly fed to a successive step or, optionally, are crimpled, cut at a desired fiber length and then subjected to a desired processing step.

The spinneret usable in step (5) of the process of the present invention may be a filament-spinneret having 50 to 1,000 spinning holes. When a staple fiber-spinneret having 1,000 to 30,000 spinning holes is used for the process of the present invention, the effect of the present invention can be realized to the maximum. Namely, the spinning solution has a high coagulation property, and therefore, even when the spinneret has a large number of spinning holes, the resultant filamentary streams of the spinning solution can be coagulated with a high stability in the aqueous coagulating bath. Generally the size of the spinning holes is 0.05 to 0.2 mm. Preferably, during the spinning procedure, the temperature of the meta aramid solution is in the range of from 50° C. to 90° C.

An aqueous coagulating solution for step (5) of the process of the present invention, a conventional aqueous inorganic salt solution can be employed. For example, an aqueous solution containing calcium chloride in a content of 34 to 42% by weight and NMP in a content of 5 to 10% by weight is preferably employed. When this type of the coagulating liquid is employed, the temperature of the liquid is preferably in the range of from 80 to 95° C.

The rate of withdrawing the coagulated filaments from the aqueous coagulating bath is preferably in the range of from 5 to 25 m/minute. From the view point of enhancing the productivity, the withdrawing rate is more preferably in the range of from 10 to 25 m/minute. The time for immersing the filaments in the coagulating liquid is preferably in the range of from 1.0 to 11 seconds.

The filaments withdrawn from the coagulating liquid are fed into the drawing step (7) in hot water through the water-washing step (6). The water-washing step (6) is preferably carried out in a plurality of stages, for example, 3 to 12 stages. For example, the filaments withdrawn from the coagulating liquid are cooled to a temperature of 60° C. or less, and then are introduced into a first water-washing bath at a temperature of 30° C. or less. In the first water-washing bath, the content of the polar inorganic solvent, for example, NMP is preferably in the range of from 15 to 25% by weight, and the washing water is supplemented to the water-washing bath so that the content of the polar inorganic solvent is maintained at the above-mentioned level. In this case, the flow rate and the solvent content of the washing water for the supplementation are provisionally designed. The immersion time of the filaments in the first water-washing bath is preferably 8 to 30 seconds. Then the filaments are further washed in a second water-washing bath at a temperature of 30 to 85° C. The amount of the washing water and the solvent content of the washing water to be supplemented into the second water-washing bath, and the immersion time of the filaments in the second water-washing bath are optionally designed so that the amount of the solvent remaining in the filaments delivered from the water-washing step becomes 15 to 25% by weight based on the weight of the polymer and the contents of calcium chloride and/or lithium chloride in the filaments become 0.5% by weight or less.

After the amount of the remaining solvent and the contents of calcium chloride and/or lithium chloride in the filaments are controlled respectively to desired levels or less in the water-washing step (6), the resultant filaments are preferably drawn at a draw ratio of 2.8 to 3.5 in the hot water drawing step (7), while the remaining solvent and salts are wash-removed from the filaments. To keep the drawing step in a good condition, the drawing operation is preferably carried out in a plurality of drawing stages, preferably two stages or more, more preferably three stages or more.

In the step (7), the drawn filaments are dried at a temperature of 100° C. or more, and heat-treated by using heating rollers or sheeting plates at a temperature of 270 to 350° C. optionally, the filaments may be further drawn on the heating plates.

The meta aramid filaments produced through the process as mentioned above are optionally packed in the form of a tow in a packing can or wound up or fed to successive steps or, optionally, are crimped, and cut to provide staple fibers, and then are subjected to successive processing procedures.

EXAMPLES

The present invention will be further explained by the following examples. In the examples, the following measurements were carried out.

(1) Intrinsic Viscosity (IV)

A sample of the aromatic polyamide was dissolved in 97% concentrated sulfuric acid and the viscosity of the solution was determined at a temperature of 30° C. by an Ostwald viscometer.

(2) Thickness

The thickness of filaments was determined in accordance with JIS L 1015.

(3) Tensile Strength and Ultimate Elongation

In accordance with JIS L 1074, a specimen having a fiber length of 20 mm was subjected to a tensile test under an initial load of 0.044 cN/dtex (0.05 g/denier) at a elongation rate of 20 mm/minute.

POLYAMIDE SOLUTION PREPERATION EXAMPLE 1

Meta-phenylenediamine in an amount of 12.977 g was dissolved in 144.3 g of dried N-methyl-2-pyrrolidone (NMP), and the solution was cooled to a temperature of −10° C. in a nitrogen gas atmosphere. While the solution was stirred, 24.425 g of particulate isophthalic acid chloride were added to the solution and then the resultant solution was subjected to a reaction at 50° C. for 2 hours. The resultant polymer exhibited an intrinsic viscosity of 1.80. A portion of hydrogen chloride produced by the polymerization was neutralized with a NMP dispersion containing 0.954 g of calcium hydroxide (in a concentration of 22.5% by weight). (The produced hydrogen chloride was neutralized at a neutralization rate of 10.7 molar %). Then the solution was added with 17.14 g of an aqueous solution of sodium hydroxide in a concentration of 50% by weight. By this addition, the neutralization reaction was effected without precipitation of the polymer. After stirring the solution for 30 minutes, the neutralization reaction was completed. After the neutralization procedure, the concentration of the polymer in the solution was 14.1% by weight, and the intrinsic viscosity of the polymer was 1.79, and the content of hydrogen chloride remaining in the solution was 0.07% by weight. The resultant solution was subjected to filtration under a pressure of 0.39 MPa (4 kg/cm$^2$), and a light-yellow-colored clear solution having a polymer concentration of 15% by weight was obtained. After the filtration, the content of non-reacted sodium hydroxide in the residual cake was measured. No sodium hydroxide was detected.

The resultant filtrate solution was extruded through 100 spinning holes, each having a hole diameter of 0.09 mm, of a spinneret into a coagulation liquid comprising, as a principal component, an aqueous solution of calcium chloride in a high concentration, to form filamentary products; the resultant filaments were washed with cold water; the washed filaments were drawn at a draw ratio of 2.4 in hot water, and the drawn filaments were washed with the hot water; the drawn filaments were dried at a temperature of 170° C. on heating rollers; and the dried filaments were dry-heated and drawn on a heating plate at a temperature of 340° C. at a draw ratio of 1.75. As a result, glossy filaments were obtained. As the properties of the resultant drawn filaments, the thickness was 2.2 dtex (2.0 de), the tensile strength was 5.74 cN/dtex (6.5 g/de) and the ultimate elongation was 39%.

The filtrate solution mentioned above was stored in a constant temperature vessel at a temperature of 70° C. for 48 hours. As a result, no gelation of the solution occurred and the solution was light-yellow-colored and was clear. The polymer exhibited an intrinsic viscosity of 1.78, and deterioration of the polymer could not be detected.

POLYAMIDE SOLUTION PREPARATION EXAMPLE 2

Meta-phenylenediamine in an amount of 78.942 g was dissolved in 1,441.7 g of dried NMP, and the solution was cooled to a temperature of −10° C. in a nitrogen gas atmosphere. While the solution was stirred, 148.65 g of melted isophthalic acid chloride were added at a temperature of 60° C. to the solution and then the resultant solution was subjected to a reaction at 70° C. for one hour. The resultant polymer exhibited an intrinsic viscosity of 2.17. Hydrogen chloride produced by the polymerization was neutralized with 122.6 g of an aqueous solution of sodium hydroxide in a concentration of 48.6% by weight, while the solution was stirred to neutralize the solution. During the neutralization, no precipitation of the polymer was found and the neutralization could be effected uniformly. A sample of the resultant solution in an amount of 2 g was dispersed in 150 g of water, the pH of the dispersion was measured, the measured pH value was 9.50. A portion of the resultant solution was subjected to a filtration under pressure. A light yellow-colored clear filtrate solution was obtained.

The filtrate solution had a pH of 7.73, and thus it was confirmed that an approximately neutral polymer solution could be obtained. Also, after the neutralization, the resultant polymer had an intrinsic viscosity of 2.14.

POLYAMIDE SOLUTION PREPARATION EXAMPLE 3

Meta-phenylenediamine in an amount of 27.035 g was dissolved in 259.75 g of a dried NMP, and the solution was cooled to a temperature of −5° C. in a nitrogen gas atmosphere. The cooled solution was mixed with 50.750 g of particulate isophthalic acid chloride and then the resultant solution was subjected to a reaction at 70° C. for one hour. After the polymerization was completed, the resultant polymer exhibited an intrinsic viscosity of 1.95. A portion of hydrogen chloride produced by the polymerization was neutralized with a NMP dispersion containing 5.96 g of calcium hydroxide (in a concentration of 22.5% by weight). (The produced hydrogen chloride was neutralized in a neutralization rate of 32.2 molar %). Then the solution was added with 46.2 g of an aqueous solution of sodium hydroxide in a concentration of 30% by weight, and the solution was stirred for 30 minutes to effect the neutralization of the solution. During the addition of the aqueous solution of sodium hydroxide, no precipitation of the polymer was found.

After the neutralization, a sample of the resultant solution in an amount of 2 g was dispersed in 150 g of water, and the pH of the dispersion was measured. The measured pH value was 10.01. A portion of the solution was filtered under pressure. A light-yellow-colored clear filtrate solution was obtained. The pH of the filtration solution was 8.01. Namely, an approximately neutral polymer solution was obtained. After the neutralization, the intrinsic viscosity of the polymer was 1.92.

POLYAMIDE SOLUTION PREPARATION EXAMPLE 4

Meta-phenylenediamine in an amount of 27.035 g was dissolved in 259.75 g of a dried NMP, and the solution was cooled to a temperature of −5° C. in a nitrogen gas atmosphere. The cooled solution was mixed with 50.758 g of particulate isophthalic acid chloride and then the resultant solution was subjected to a reaction at 70° C. for one hour. After the reaction was completed, the resultant polymer exhibited an intrinsic viscosity of 1.99. A portion of hydrogen chloride produced by the polymerization was neutralized with a NMP dispersion containing 5.96 g of calcium hydroxide (in a concentration of 22.5% by weight). (The produced hydrogen chloride was neutralized in a neutralization rate of 32.2 molar %). Then the solution was added with 21.28 g of an aqueous solution of sodium hydroxide having a concentration of 65% by weight and heated to a temperature of 70° C., and stirred for 30 minutes to neutralize the solution. In addition, no precipitation of sodium hydroxide and the polymer was found.

After the neutralization was completed, a sample of the resultant solution in an amount of 2 g was dispersed in 150 g of water, and the pH of the dispersion was measured. The resultant pH value was 9.88. A portion of the 'solution was filtered under pressure. A light-yellow-colored clear filtrate solution was obtained. The pH of the filtration solution was 8.02. Namely, an approximately neutral polymer solution was obtained. The neutralized polymer exhibited an intrinsic viscosity of 1.94.

POLYAMIDE SOLUTION PREPARATION EXAMPLE 5

Meta-phenylenediamine in an amount of 21.628 g was dissolved in 245.8 g of a dried N,N-dimethylacetamide (DMAc), and the solution was cooled to a temperature of −10° C. in a nitrogen gas atmosphere. While the solution was stirred, 40.7075 g of ground isophthalic acid chloride were added to the resultant solution and then the resultant solution was subjected to a reaction at 50° C. for 2 hours. The resultant polymer exhibited an intrinsic viscosity of 1.75. A portion of hydrogen chloride produced by the polymerization was neutralized with a NMAc dispersion containing 1.59 g of calcium hydroxide (in a concentration of 22.5% by weight). (The produced hydrogen chloride was neutralized in a neutralization rate of 10.7 molar %). Then the solution was added with 29.42 g of an aqueous solution of sodium hydroxide in a concentration of 50% by weight. During the addition of the sodium hydroxide solution no precipitation of the polymer occurred. After stirring for 30 minutes, the neutralization reaction was completed. After the neutralization procedure, the concentration of the polymer in the solution was 14.1% by weight, and the intrinsic viscosity of the polymer was 1.73.

All of the hydrogen chloride contained in the solution was completely neutralized. When a sample of the solution in an amount of 2 g was dispersed in 150 ml of water, and the pH of the dispersion was measured, the measured pH value was 9.5. The solution was filtered and a light-yellow-colored clear filtrate solution having a polymer concentration of 15% by weight was obtained. The filtrate solution was subjected to pH measurement. The measured pH value was 7.8. Namely, a neutral solution was obtained.

POLYAMIDE SOLUTION PREPARATION EXAMPLE 6

Meta-phenylenediamine in an amount of 21.628 g was dissolved in 245.8 g of a dried NMP, and the solution was cooled to a temperature of −10° C. in a nitrogen gas atmosphere. While the solution was stirred, 40.7075 g of powdered isophthalic acid chloride were added to the solution and then the resultant solution was subjected to a reaction at 70° C. for one hour. The resultant polymer exhibited an intrinsic viscosity of 1.88. A portion of hydrogen chloride produced by the polymerization was neutralized with a NMP dispersion containing 4.77 g of calcium hydroxide (in a concentration of 22.5% by weight). (The produced hydrogen chloride was neutralized in a neutralization rate of 32.2 molar %). Then the solution was added with 31.35 g of an aqueous solution of potassium hydroxide in a concentration of 50% by weight. During this addition, no precipitation of the polymer occurred. After stirring for 30 minutes, the neutralization reaction was completed. After the neutralization procedure, the intrinsic viscosity of the polymer was 1.85.

After the neutralization, a sample of the solution in an amount of 2 g was dispersed in 150 ml of water, and the pH of the dispersion was measured. The measured pH value was 10.01. The solution was filtered under pressure. A light-yellow-colored clear filtrate solution was obtained. A sample of the solution in an amount of 2 g was dispersed in 150 ml of water and the pH of the dispersion was measured. The measured pH value was 8.01. From this fact, it was confirmed that an excessive fraction of potassium hydroxide was removed by the filtration.

POLYAMIDE SOLUTION PREPARATION COMPARATIVE EXAMPLE 1

Meta-phenylenediamine in an amount of 12.977 g was dissolved in 144.3 g of a dried N-methyl-2-pyrrolidone (NMP), and the solution was cooled to a temperature of −10° C. in a nitrogen gas atmosphere. While the solution was stirred, 24.425 g of particulate isophthalic acid chloride were added to the solution and then the resultant solution was subjected to a reaction at 50° C. for 2 hours. The resultant polymer exhibited an intrinsic viscosity of 1.90. A portion of hydrogen chloride produced by the polymerization was neutralized with a NMP dispersion containing 8.89 g of calcium hydroxide (in a concentration of 22.5% by weight). After stirring for 30 minutes, the neutralization reaction was completed. After the neutralization procedure, the concentration of the polymer in the solution was 15.0% by weight, and the intrinsic viscosity of the polymer was 1.87, and the content of hydrogen chloride remaining in the solution was 0.03% by weight. It was confirmed that the solution was slightly muddy. The resultant solution was subjected to a filtration under a pressure of 0.39 MPa (4 kg/cm$^2$).

The resultant filtrate solution was subjected to the spinning procedure under the same conditions as in Polyamide Solution Preparation Example 1. As a result, it was found that a large number of breakages of individual filaments occurred, the broken filaments were wound up around rollers many times and, thus, the formation of the filaments was difficult.

POLYAMIDE SOLUTION PREPARATION COMPARATIVE EXAMPLE 2

Meta-phenylenediamine in an amount of 12.977 g was dissolved in 147.6 g of a dried NMP, and the solution was cooled to a temperature of −10° C. in a nitrogen gas atmosphere. Into the resultant solution, 24.425 g of powdered isophthalic acid chloride were added and then the resultant solution was subjected to a reaction at 50° C. for 2 hours. The resultant polymer exhibited an intrinsic viscosity of 1.92. The polymerization reaction solution was added with a NMP dispersion of 0.954 g of calcium hydroxide (concentration: 22.5% by weight) to neutralize a portion of hydrogen chloride produced by the polymerization. Then, the solution was further neutralized by adding a dispersion of 8.57 g of solid sodium hydroxide in NMP and stirring the mixed solution for 60 minutes. After the neutralization and the stirring for 30 minutes, the resultant polymer exhibited an intrinsic viscosity of 1.88, and after the stirring for 60 minutes, the intrinsic viscosity of the polymer was decreased to 1.80. The neutralized solution was subjected to a filtration. A sample of the resultant clear solution in an amount of 2 g was dispersed in 150 ml of water and subjected to a pH measurement.

The measured pH value was 3.5, and it was confirmed that a large amount of hydrogen chloride was remained in the solution. Also, a sample of the cake separated from the neutralized solution in an amount of 2 g was dispersed in 150 ml of water and the pH of the dispersion was measured. The measured pH value was 11.1, and it was confirmed that a large amount of non-reacted sodium hydroxide is remained in the cake.

POLYAMIDE SOLUTION PREPARATION COMPARATIVE EXAMPLE 3

Meta-phenylenediamine in an amount of 12.977 g was dissolved in 147.6 g of a dried NMP, and the solution was cooled to a temperature of −10° C. in a nitrogen gas atmosphere. Into the resultant solution, 24.425 g of powdered isophthalic acid chloride were added and then the resultant solution was subjected to a reaction at 50° C. for 2 hours. The resultant polymer exhibited an intrinsic viscosity of 1.95. A portion of hydrogen chloride produced by the polymerization was neutralized with a NMP dispersion containing 0.954 g of calcium hydroxide (in a concentration of 22.5% by weight), and then the solution was added with 20.21 g of hydrogen sodium carbonate, and stirred for 30 minutes to neutralize the solution. During this procedure, a large amount of carbon dioxide gas was generated so that the solution was bubbled. The neutralized solution was subjected to a centrifugal separation, a sample of the resultant clear filtrate solution in an amount of 2 g was dispersed in 150 ml of water, and the pH of the dispersion was measured.

The measured pH value was 3.5. Also, a sample of the separated cake in an amount of 2 g was dispersed in 150 ml of water and the pH of the dispersion was measured. The measured pH value was 10.8. Thus, it could be confirmed that the polymerization reaction solution could not be completely neutralized with a high efficiency. After the neutralization procedure was ended, the polymer exhibited an intrinsic viscosity of 1.90. The filtrate solution was stored in a constant temperature vessel at a temperature of 70° C. for 24 hours. As a result, the intrinsic viscosity of the polymer was reduced to 1.68, and thus it was confirmed that the polymer was deteriorated.

Example 1

A reaction container equipped with a thermometer, a stirrer and material-feeding inlet was charged with 961.0 parts by weight of NMP having a water content of 100 ppm or less, and 100.0 parts by weight of meta-phenylenediamine were dissolved in the NMP. The resultant solution was cooled to a temperature of 0° C. Into the cooled diamine solution, 187.7 parts by weight of isophthalic acid chloride were gradually added to cause them to be reacted with each other. During the reaction, the temperature of the reaction solution raised up to 70° C. After the stirring was continued for 60 minutes after the start of the reaction, 98.0 parts by weight of an NMP slurry of calcium hydroxide in a concentration of 22.5 parts by weight was mixed to the solution, and then the mixed solution was stirred for 20 minutes. Then, to the resultant solution, 104.1 parts by weight. of an aqueous solution of sodium hydroxide in a concentration of 44.0% by weight were mixed, the resultant mixed solution was stirred for 60 minutes to complete the reaction, and then the resultant polymer solution was taken up from the reaction container. The polymer solution was filtered at a temperature of 90° C. to remove the precipitated sodium chloride. A clear polymer solution was collected. In the filtration, the filtering rate per unit filtering area was 25 kg/m$^2$. The filtrate polymer solution was maintained at a temperature of 60° C.

From this polymer solution, the resultant polymetaphenyleneisophthalamide was isolated, and the intrinsic viscosity (IV) of the polymer was measured. The measured IV value was 1.97. Also, in the polymer solution, the concentration of the polymer was 16.0% by weight, the content of calcium chloride was 15% by weight based on the weight of the polymer, and the content of water was 39.4% by weight based on the weight of the polymer.

The polymer solution in an amount of 100 parts by weight was mixed with 3.22 parts by weight of a solution of NMP in water in a mixing ratio water/NMP of 25/75. A clear spinning solution was obtained. In this spinning solution, the concentration of the polymer was 15.5% by weight and the content of water was 44.4% by weight based on the weight of the polymer.

The spinning solution (60° C.) was directly extruded through a spinneret having a spinning hole diameter of 0.07 mm and 15,000 spinning holes into a coagulation liquid and the resultant filamentary product was taken up from the coagulation liquid. The coagulation liquid consisted of an aqueous solution comprising 40% by weight of calcium chloride and 5% by weight of NMP and had a temperature of 90° C. The immersion time of the filaments in the coagulation liquid was 1.7 seconds, and the coagulated filaments were taken up at a speed of 16 m/min.

The resultant filament bundle was cooled to a temperature of 50° C., introduced into and passed through a first water-washing bath at a water temperature of 25° C., a second water-washing bath at a water temperature of 45° C. and a third water-washing bath at a water temperature of 70° C., to wash, with water, the filaments to such an extent that the amount of the solvent remaining the filaments is reduced to 18% by weight based on the weight of the polymer. In this washing procedure, the composition of the aqueous solution for the first water-washing bath was controlled so that the contents of NMP was maintained at 22% by weight and the content of calcium chloride was maintained at 14% by weight.

The water-washed filaments were subjected to a three step drawing procedure in a hot water at a temperature of 98° C. at a first draw ratio of 1.4 in the first step, a second draw ratio of 1.95 in the second step and a third draw ratio of 1.1 in the third step.

The drawn filaments were passed through a drying roll at a temperature of 170° C. to dry the filaments; pre-heated on a pre-heating roller at a temperature of 200° C., heat-set on a roller at a temperature of 340° C., and cooled on a cooling roller to a temperature of 30° C. The cooled filaments were oiled with an oiling agent and wound up. A drawn filament tow of a yarn count of 33,333.3 dtex/15,000 filaments (30,000 denier/15,000 filaments) was obtained. While observing the forwarding of the filament tow after the hot water drawing procedure, the number of the detected fluffs on the filament tow was less than 1 fluff/min, which is low and good. Also, filtration pressure-rising rate of the filter located upstream to the spinneret for the spinning solution was less than 0.1 MPa/day which is low and good.

Comparative Example 1

A reaction container equipped with a thermometer, a stirrer and material-feeding inlet was charged with 993.0 parts by weight of NMP having a water content of 100 ppm or less, and 100.0 parts by weight of meta-phenylenediamine were dissolved in the NMP. The resultant solution was cooled to a temperature of 0° C. Into the cooled diamine solution, 187.7 parts by weight of isophthalic acid chloride were gradually mixed to cause them to be reacted with each other. During the reaction, the temperature of the reaction solution increased to 70° C. After the stirring was continued for 60 minutes after the start of the reaction, 98.0 parts by weight of an NMP slurry of calcium hydroxide in a concentration of 22.5 parts by weight was mixed to the solution, and then the mixed solution was stirred for 20 minutes. Then, the resultant solution and 115.0 parts by weight of an aqueous solution of sodium hydroxide in a concentration of 44.0% by weight were mixed, the resultant mixed solution was stirred for 60 minutes to complete the reaction, and then the resultant polymer solution was taken up from the reaction container. The polymer solution was filtered at a temperature of 90° C. to remove the precipitated sodium chloride. A clear polymer solution was collected. In the filtration, the average filtering rate per unit filtering area during the time between 30 minutes to 3 hours after the start of the filtration was 30 kg/m$^2$/hr. The resultant filtrate polymer solution was maintained at a temperature of 60° C.

From this polymer solution, the resultant polymetaphenyleneisophthalamide was isolated, and the intrinsic viscosity (IV) of the polymer was measured. The measured IV value was 1.97. Also, in the polymer solution, the concentration of the polymer was 15.5% by weight, the content of calcium chloride was 15% by weight based on the weight of the polymer, and the content of water was 44.4% by weight based on the weight of the polymer.

The polymer solution was employed as a spinning solution (60° C.), and the spinning solution was subjected to spinning, water-washing, drawing and heat-treating procedures in the same manner as in Example 1.

A drawn filament tow of a yarn count of 33,333.3 dtex/15,000 filaments (30,000 denier/15,000 filaments) was obtained. In the spinning procedure, the filtration pressure on the filter located upstream to the spinneret increased at a rate of 0.5 MPa/hour, and thus the spinning operation could not be continued over a long time. While observing the forwarding of the filament tow after the hot water drawing procedure, the number of the detected fluffs on the filament tow was less than 1 fluff/min which is small and good. The resultant filaments had a high gloss.

The filter located upstream to the spinneret was checked and it was confirmed that the filter was soiled with salt.

Comparative Example 2

The same polymer solution as that obtained in Comparative Example 1 was cooled to a temperature of 30° C. The cooled polymer solution was filtered at the above-mentioned temperature to remove sodium chloride. A clear polymer solution was obtained. In the filtration, the average filtration rate per unit filtration area was 9 kg/m$^2$. Thus the polymer solution was found inappropriate to practical production of the filaments.

The filtered polymer solution was heated to a temperature of 60° C., and subjected to the same spinning, water-washing, drawing and heat-treating procedures, and a drawn filament tow having a yarn count of 33,333 dtex/15,000 filaments (30,000 denier/15,000 filaments) was obtained. The filtration pressure rising rate on the filter located upstream to the spinneret was less than 0.1 MPa/day which is low and good. After the drawing procedure in hot water, the forwarding filament tow was checked. As a result, the number of the detected fluffs was less than 1 fluff/min which is small and good. The filaments were glossy filaments.

Example 2

A reaction container equipped with a thermometer, a stirrer and material-feeding inlet was charged with 918.0 parts by weight of NMP having a water content of 100 ppm or less, and 100.0 parts by weight of meta-phenylenediamine were dissolved in the NMP, and the resultant solution was cooled to a temperature of 0° C. in the same manner as in Example 1. Into the cooled diamine solution, 187.7 parts by weight of isophthalic acid chloride were gradually added to cause them to be reacted with each other. During the reaction, the temperature of the reaction solution raised up to 70° C. After the stirring was continued for 60 minutes after the start of the reaction, 65.5 parts by weight of an NMP slurry of calcium hydroxide in a concentration of 22.5 parts by weight was mixed to the solution, and then the mixed solution was stirred for 20 minutes. Then, to the resultant solution, 120.0 parts by weight of an aqueous solution of sodium hydroxide in a concentration of 44.0% by weight were mixed, and the resultant mixed solution was stirred for 60 minutes to complete the reaction. Then the resultant polymer solution was taken up from the reaction container, and filtered at a temperature of 90° C. to remove the precipitated sodium chloride. A clear polymer solution was collected. In the filtration, the average filtering rate per unit filtering area during the time between 30 minutes and 3 hours after the start of the filtration was 21 kg/m$^2$/hr. The filtrate polymer solution was maintained at a temperature of 60° C.

From this polymer solution, the resultant polymetaphenyleneisophthalamide was isolated, and the intrinsic viscosity (IV) of the polymer was measured. The measured IV value was 1.95. Also, in the polymer solution, the concentration of the polymer was 16.9% by weight, the content of calcium chloride was 10% by weight based on the weight of the polymer, and the content of water was 43.1% by weight based on the weight of the polymer.

The polymer solution in an amount of 100 parts by weight was mixed with 4.56 parts by weight of a solution of NMP in water in a mixing ratio of water to NMP of 25/75. A clear spinning solution was obtained. In this spinning solution, the concentration of the polymer was 16.1% by weight and the content of water was 49.9% by weight based on the weight of the polymer.

The spinning solution (60° C.) was subjected to the same spinning, water-washing, drawing and heat-treating procedures as those in Example 1.

A drawn filament tow of a yarn count of 33,333.3 dtex/15,000 filaments (30,000 denier/15,000 filaments) was obtained. While observing the forwarding of the filament tow after the hot water drawing procedure, the number of the detected fluffs on the filament tow was less than 1 fluff/min, which is small and good. The resultant filaments were glossy. Also, filtration pressure-rising rate of the filter located upstream to the spinneret for the spinning solution is less than 0.1 MPa/day which is low and good.

Example 3

A reaction container equipped with a thermometer, a stirrer and material-feeding inlet was charged with 981.7 parts by weight of NMP having a water content of 100 ppm or less, 100.0 parts by weight of meta-phenylenediamine were dissolved in the NMP, and the resultant solution was cooled to a temperature of 0° C., in the same manner as in Example 1. To the cooled diamine solution, 187.7 parts by weight of isophthalic acid chloride were gradually added to cause them to be reacted with each other. During the reaction, the temperature of the reaction solution raised up to 70° C. After the stirring was continued for 60 minutes after the start of the reaction, 98.0 parts by weight of an NMP slurry of calcium hydroxide in a concentration of 22.5 parts by weight was mixed to the solution, and then the mixed solution was stirred for 20 minutes. Then, the resultant solution and 83.9 parts by weight of an aqueous solution of sodium hydroxide in a concentration of 60.0% by weight were mixed, the resultant mixed solution was stirred for 60 minutes to complete the reaction, and then the resultant polymer solution was taken up from the reaction container. The polymer solution was filtered at a temperature of 90° C. to remove the precipitated sodium chloride. A clear polymer solution was collected. In the filtration, the average filtering rate per unit filtering area during the time between 30 minutes to 3 hours after the start of the filtration was 25 kg/m2/hr. The filtrate polymerization solution was maintained at a temperature of 60° C.

From this polymerization solution, the resultant polymetaphenyleneisophthalamide was isolated, and the intrinsic viscosity (IV) of the polymer was measured. The measured IV value was 1.95. Also, in the polymer solution, the concentration of the polymer was 16.0% by weight, the content of calcium chloride was 15% by weight based on the weight of the polymer, and the content of water was 30.4% by weight based on the weight of the polymer.

The polymer solution in an amount of 100 parts by weight was mixed with 3.22 parts by weight of a solution of NMP in water in a mixing ratio of water to NMP of 25/75. A clear spinning solution was obtained. In this spinning solution, the concentration of the polymer was 15.5% by weight and the content of water was 35.4% by weight based on the weight of the polymer.

The spinning solution (60°) was subjected to the same spinning, water-washing, drawing and heat-treating procedures as those in Example 1, and a drawn filament tow of a yarn count of 33,333.3 dtex/15,000 filaments (30,000 denier/15,000 filaments) was obtained. While observing the forwarding of the filament tow after the hot water drawing procedure, the number of the detected fluffs on the filament tow was less than 1 fluff/min, which was small and good. The resultant filaments were glossy. Also, filtration pressure-rising rate of the filter located upstream to the spinneret for the spinning solution was less than 0.1 MPa/day which was low and good.

As results of the above-mentioned examples and comparative examples, the tensile strength and elongation property of the resultant filaments and the amount of voids formed in the coagulated filaments and determined by naked eye observation are shown in Table 1.

Industrial Applicability

In accordance with the production process of the present invention, meta aramid fibers having excellent quality can be produced from a meta aramid solution having an excellent stability and a superior coagulation property in a wet-spinning procedure with excellent processability and high productivity.

What is claimed is:

1. A process for producing meta aramid filaments by preparing a polymer solution of a meta aramid by a solution polymerization method and producing meta aramid filaments from the polymer solution, which process comprises a series of steps(1) to (7) of:

(1) a polymerization step in which a meta aramid is prepared by reacting a aromatic meta-diamine with a aromatic meta-dicarboxylic acid chloride in a polar organic solvent;

(2) a neutralization step in which hydrogen chloride contained in the polymer solution obtained in the polymerization step (1) is neutralized with a neutralizing agent comprising at least one member selected from the group consisting of sodium hydroxide and potassium hydroxide which form a salt insoluble in the polymerization solvent when reacted with the hydrogen chloride;

(3) a filtering step in which the salt deposited from the polymer solution in the neutralization step (2) is removed by filtration;

(4) a spinning solution-preparation step in which the polymer solution obtained in the filtering step (3) is mixed with water and a polar organic amide solvent, to provide a spinning solution;

(5) a coagulation step in which the meta aramid-spinning solution obtained in the spinning solution-preparation step (4) is directly extruded in filamentary streams into an aqueous coagulation liquid to coagulate the extruded spinning solution streams into the form of filaments;

(6) a water-washing step in which the filaments delivered from the coagulation step (5) are immersed in water to remove the salts and the solvent from the filaments; and (7) drawing and heat-treatment steps in which the filaments delivered from the water-washing step (6) are drawn and heat-treated.

2. The process for producing meta aramid filaments as claimed in claim 1, wherein in the spinning solution-preparation step (4), the meta aramid solution is added with

TABLE 1

| | | Item | | | | | | | | |
|---|---|---|---|---|---|---|---|---|---|---|
| | | Spinning solution | | | Salt filtering property | | | Properties of drawn filaments | | |
| Example No. | | Polymer concentration (wt %) | $CaCl_2$ Content (PHR) | Water content (PHR) | Filtration rate (kg/m²/hr) | Filtration pressure rising rate (Mpa/day) | Coagulated filaments Void amount | Fluffs (Fluff/min) | Tensile strength (cN/dtex) | Ultimate elongation (%) |
| Example | 1 | 15.5 | 15.0 | 44.4 | 25 | <0.1 | Little | <1 | 4.15 | 59 |
| | 2 | 16.1 | 10.0 | 49.4 | 21 | <0.1 | Little | <1 | 4.33 | 56 |
| | 3 | 15.5 | 15.0 | 35.4 | 25 | <0.1 | Little | <1 | 4.06 | 60 |
| Comparative | 1 | 15.5 | 15.0 | 44.4 | 30 | 11 | Little | <1 | 4.15 | 59 |
| Example | 2 | 15.5 | 15.5 | 44.4 | 9 | <0.1 | Little | <1 | 4.15 | 59 |

a polar organic solvent-water mixed liquid having a water content of 25% by weight or less.

3. The process for producing meta aramid filaments as claimed in claim 1, wherein 85 molar % or more of the recurring units of the meta aramid obtained in the polymerization step (1) are meta-phenyleneisophthalamide units.

4. The process for producing meta aramid filaments as claimed in claim 1, wherein in the neutralization step (2), the polymer solution is added with an aqueous solution of the alkali metal hydroxide.

5. The process for producing meta aramid filaments as claimed in claim 4, wherein the alkali metal hydroxide is in a concentration of 20 to 70% in the aqueous alkali metal hydroxide solution.

6. The process for producing meta aramid filaments as claimed in claim 1, further comprising a step (8) for adding calcium chloride or lithium chloride to the polymer solution, before the neutralization step.

7. The process for producing meta aramid filaments as claimed in claim 1, wherein in the neutralization step (2), the neutralizing agent contains at least one member selected from calcium hydroxide and lithium hydroxide, and 5 to 55 molar % of the total amount of hydrogen chloride contained in the polymer solution are neutralized with calcium hydroxide and/or lithium hydroxide.

8. The process for producing meta aramid filaments as claimed in claim 6, or 7, wherein the spinning solution contains calcium chloride and/or lithium chloride in an amount of 3 to 25% by weight based on the weight of the meta aramid.

9. The process for producing meta arachnid filaments as claimed in claim 1, wherein the spinning solution contains the meta aramid in a concentration of 12 to 18% by weight, and water in a content of 25 to 70% by weight based on the weight of the meta aramid.

10. The process for producing meta aramid filaments as claimed in claim 1, wherein in the polymerization step (1), the organic polar solvent comprises at least one member selected from N-methyl-2-pyrrolidone, N,N-dimethylacetamide, N,N-dimethylformamide, dimethylsulfoxide, N-methylcaprolactame, N,N,N',N'-tetramethylurea.

* * * * *